US006547598B1

(12) United States Patent
Chen

(10) Patent No.: US 6,547,598 B1
(45) Date of Patent: Apr. 15, 2003

(54) SOCKET CONNECTOR USED IN LAN

(75) Inventor: Pin-Hung Chen, Kaohsiung (TW)

(73) Assignee: Taimag Corporation, Kaohsiung (TW)

( * ) Notice: Subject to any disclaimer, the term of this patent is extended or adjusted under 35 U.S.C. 154(b) by 0 days.

(21) Appl. No.: 10/054,401

(22) Filed: Jan. 22, 2002

(51) Int. Cl.[7] ..... H01R 13/66
(52) U.S. Cl. ..... 439/620; 439/76.1
(58) Field of Search ..... 439/76.1, 620, 439/676

(56) References Cited

U.S. PATENT DOCUMENTS 867,690 A * 10/1907 Thumma ..... 55/410
5,647,767 A * 7/1997 Scheer et al. ..... 439/620
6,102,741 A * 8/2000 Boutros et al. ..... 439/620
6,171,151 B1 * 1/2001 Lu et al. ..... 439/620

* cited by examiner

*Primary Examiner*—Gary Paumen
*Assistant Examiner*—James R. Harvey
(74) *Attorney, Agent, or Firm*—Alan Kamrath; Rider, Bennett, Egan & Arundel, LLP

(57) ABSTRACT

An RJ45 type network socket connector consists of a dielectric housing and a unit body inserted into the housing so as to increase the manufacturing efficiency of the connector. The unit body has a base with a bracket extending horizontally from a front side thereof, a PCB secured on a top of the base, a transformer positioned on the PCB, an inner contact portion arranged on the bracket and an outer contact portion extended through the base. The unit body is easily inserted from a step-shaped entry into a rear space of the housing and the bracket is extended into a receiving groove defined in a socket cavity formed in a front space of the housing and then securely positioned in the housing.

2 Claims, 4 Drawing Sheets

SOCKET CONNECTOR USED IN LAN

BACKGROUND OF THE INVENTION

1. Field of the Invention

The present invention relates to a socket connector used in the network industry and consisting of a unit body inserted into a main dielectric housing in order to benefit manufacturing of the connector.

2. Description of Related Art

The RJ45 connector has become a standard type socket connector used in the local area network (LAN) to connect computers and servers together. As shown in FIG. 4, a conventional RJ45 connector (3) comprises a main dielectric housing (30) having a partition (31) integrated therein to divide an inner space thereof into an upper space and a lower space, a socket cavity (32) formed in the lower space, a PCB (33) mounted on a bottom of the upper space, and a transformer (34) positioned on the PCB (33). An outer contact portion (35) is electrically connected with the PCB (33) and extended outward through one side wall of the housing (30). An inner contact portion (not shown) is electrically connected with the PCB (33) and extended through the partition (31) into the socket cavity (32).

The upper space is provided to receive the transformer (34), which consists of multiple windings (341), capacities, and resistances etc. Finally a sealing resin (36) is poured into the upper space of the housing (30) to protect the components of the transformer (34) therein. However, the upper space of the housing (30) is very narrow, and so a significant level of skill in manufacturing is required to arrange all components of the transformer (34) in the limited upper space in a high density arrangement. Moreover because of the difficulty of manufacturing, the defect rate of the conventional connector is also high, so that the production cost of the connector is high.

Therefore, it is an objective of the invention to provide an improved RJ45 type network socket connector to mitigate and/or obviate the aforementioned problems.

SUMMARY OF THE INVENTION

The main object of the present invention is to provide an RJ45 type socket connector having a unit body inserted into a dielectric housing. Wherein the unit body has a PCB mounted on a base, an inner contact portion arranged along a bracket and an outer contact portion extended downward through the base. After a transformer is assembled and securely positioned on the PCB, the unit body is easily inserted from a step-shaped entry into a rear space of the housing and the bracket is inserted into a socket cavity formed in a front space of the housing, whereby the RJ45 connector is advantageously assembled under a high manufacturing efficiency.

Another object of the invention is to provide an RJ45 type socket connector, wherein the unit body is replaceable, so that the defect rate of the invention is low and the production cost is also low.

Other objects, advantages and novel features of the invention will become more apparent from the following detailed description when taken in conjunction with the accompanying drawings.

DETAILED DESCRIPTION OF THE PREFERRED EMBODIMENT

Figure 1:
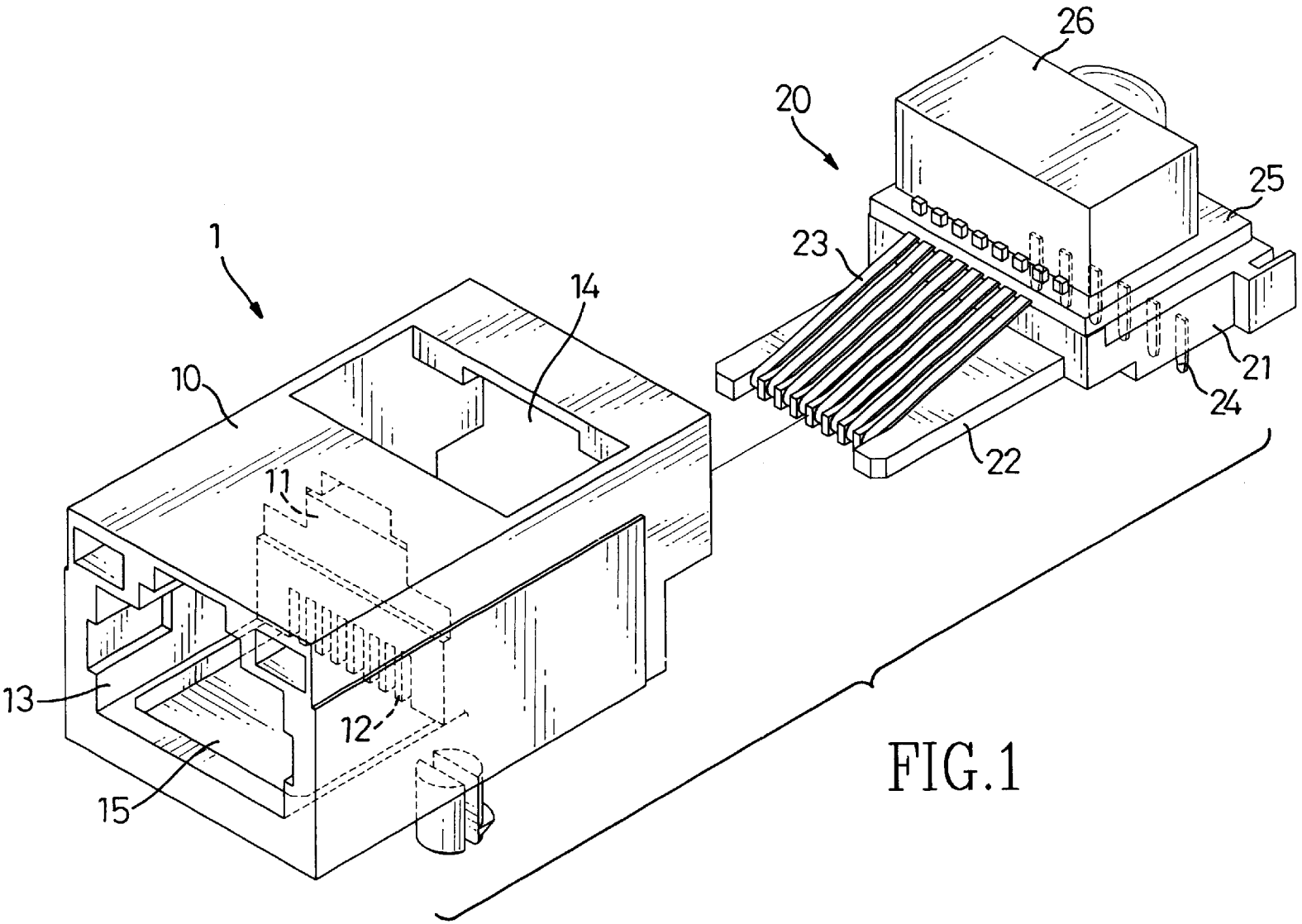
FIG. 1 is an exploded perspective view of an RJ45 type network socket connector in accordance with the invention.

Referring to FIG. 1, an RJ45 type network socket connector (1) comprises a main dielectric housing (10) having a vertical partition (11) integrated therein to divide an inner space thereof into a front space and a rear space, and a unit body (20) inserted from the rear space into the main dielectric housing (10).

The front space forms a socket cavity (13) according to the standard size of an RJ45 socket. A lower side of the socket cavity (13) is defined with a receiving groove (15) in communication with the rear space. The rear space of the housing (10) has a step-shaped entry (14) formed at a rear end thereof. A grid section (12) is formed at a lower side of the partition (11) near the receiving groove (15) and defined with eight slots therein.

The unit body (20) has a base (21) with a bracket (22) extending horizontally from a front side thereof, an inner contact portion (23) arranged on the bracket (22), an outer contact portion (24) extended downward through the base (21), a PCB (25) secured on a top of the base (21), and a transformer (26) securely positioned on the PCB (25) in electrical connection with the PCB. The inner contact portion (23) has eight contact ramps arranged there along corresponding to the eight slots of the grid section (12) and electrically connected to the PCB (25). The outer contact portion (24) is also electrically connected to the PCB (25).

Figure 2:
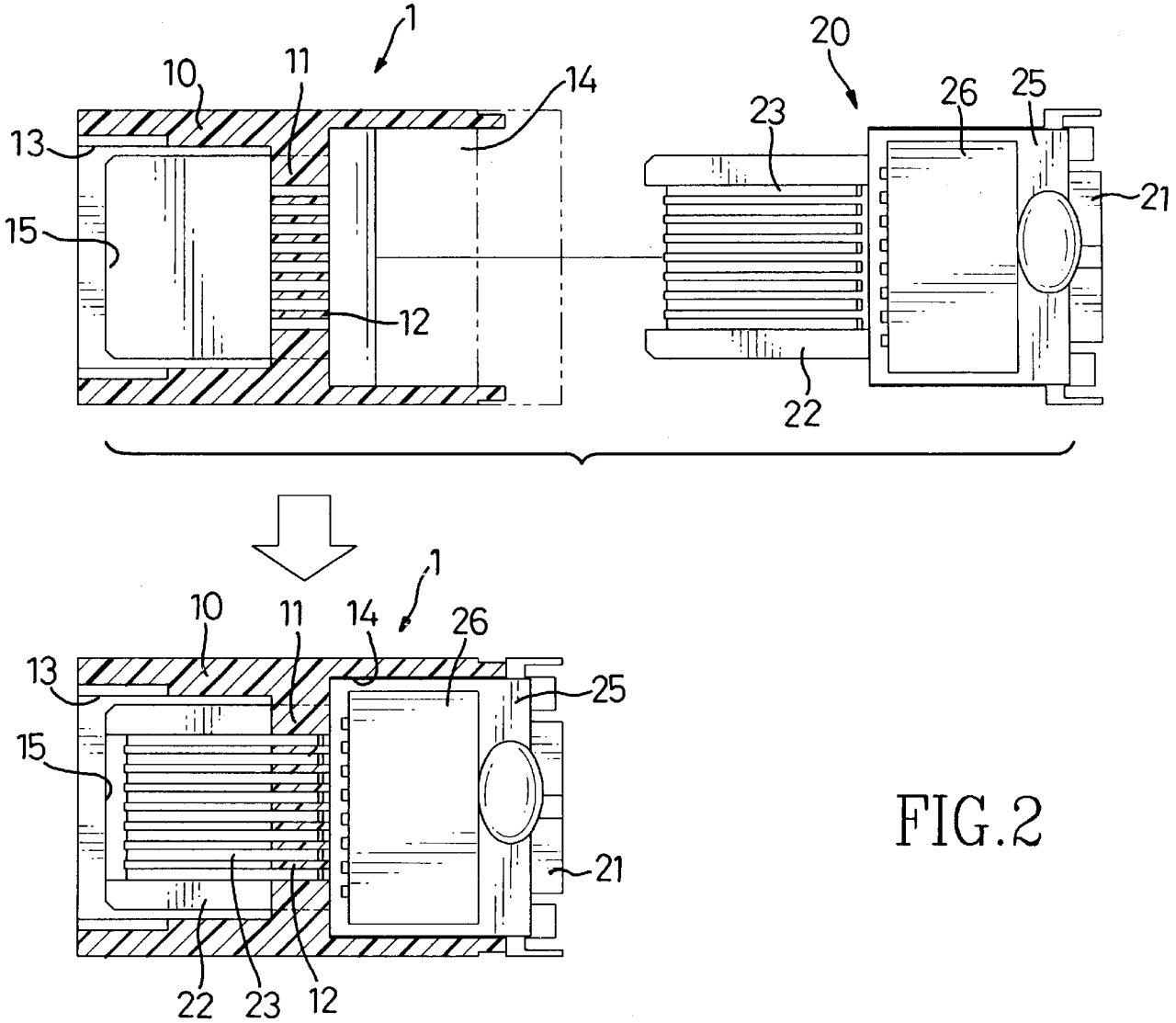
FIG. 2 is a schematic assembly view of the RJ45 type network socket connector in accordance with the invention.
Figure 3:
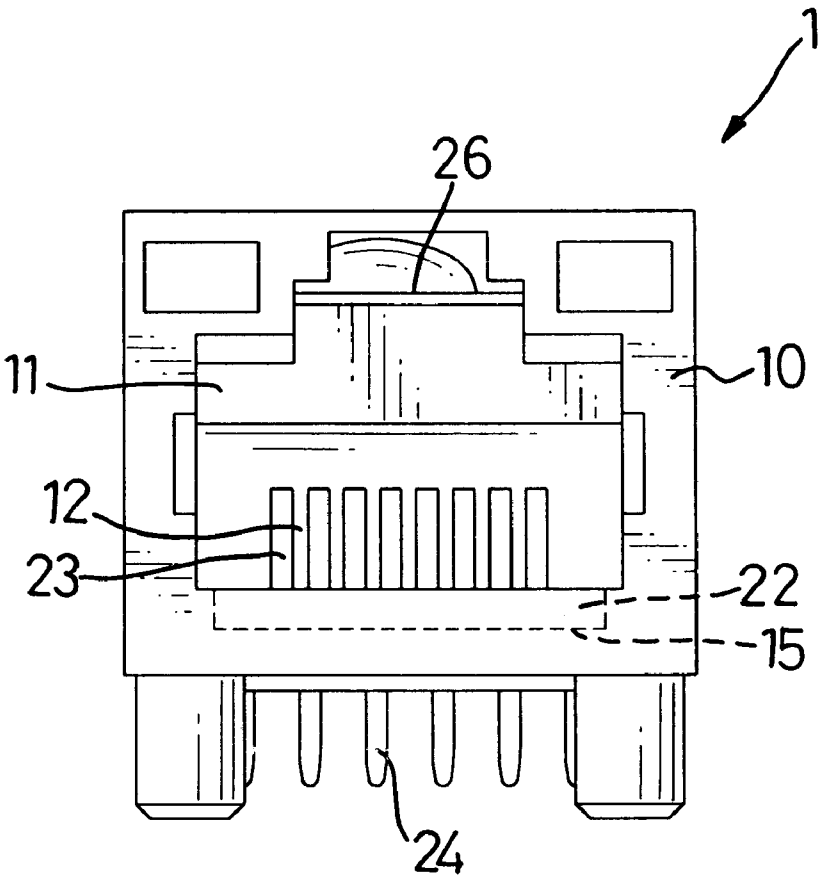
FIG. 3 a front side view of the RJ45 type network socket connector in accordance with the invention.
Figure 4:
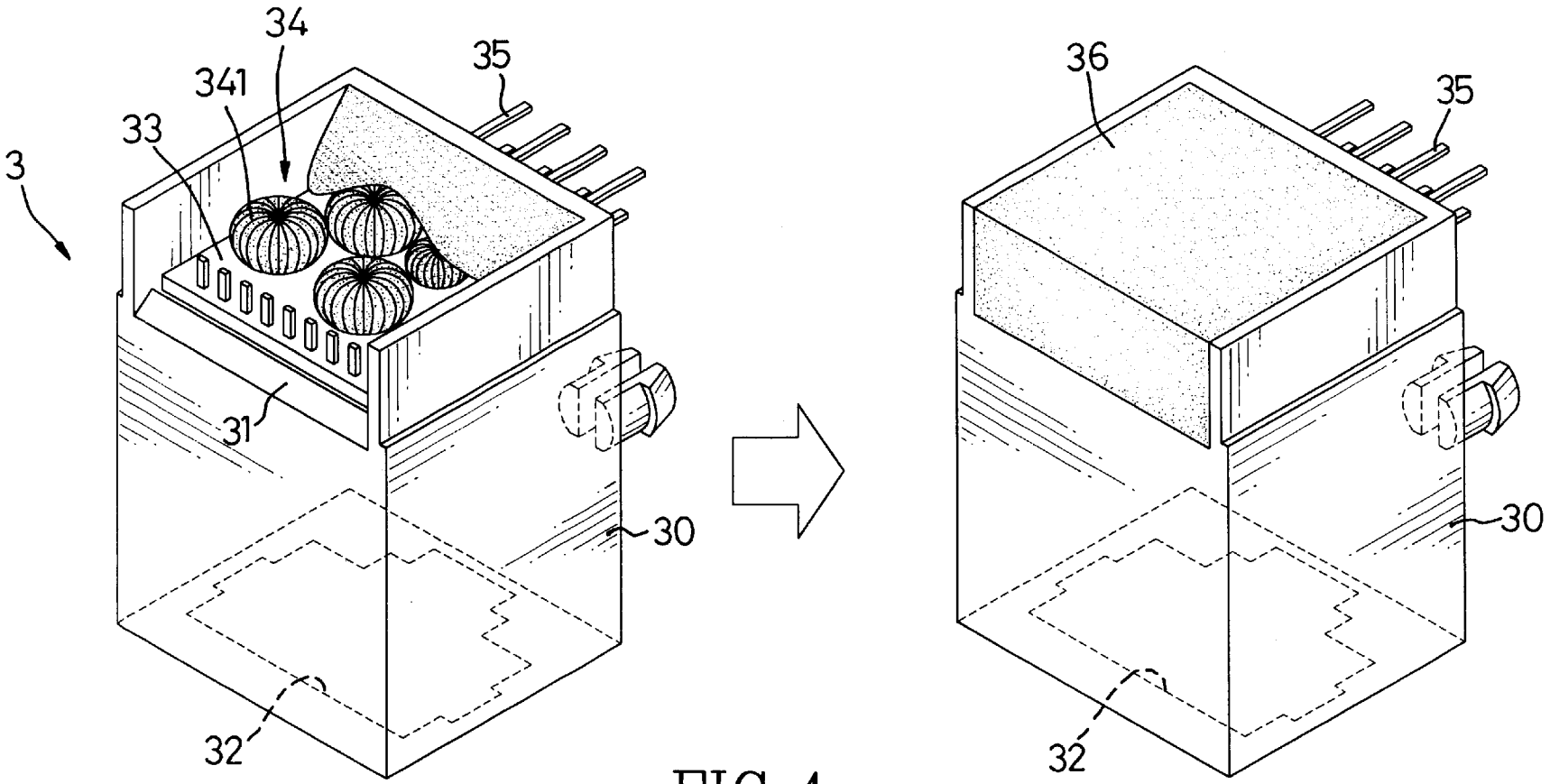
FIG. 4 PRIOR ART
FIG. 4 is a schematic view of a conventional RJ45 type network socket connector.

Referring to FIGS. 2 and 3, the unit body (20) is inserted from the rear into the step-shaped entry (14) and into the housing (10). The bracket (22) is inserted into and securely positioned in the receiving groove (15). The base (21), the PCB (25) and the transformer (26) are received in the rear space of the housing (10).

Due to the structure of the unit body (20) and the housing (10), the transformer (26) is easily secured on the PCB (25), and the unit body (20) is also easily inserted into the housing (10) until the bracket (22) is precisely positioned in the receiving groove (15) of the housing (10), therefore the structure of the connector (1) of the invention benefits improving manufacturing efficiency and reducing production cost.

The connector (1) of the invention also decreases the defect rate of the manufacture, because the unit body (20) is replaceable and so the entire connector does not have to be scrapped if only the unit body (20) is defective.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. In a network socket connector consisting of a dielectric housing and a unit body inserted into the housing, wherein the housing has a vertical partition integrated therein to divide an inner space thereof into a front space and a rear space, a socket cavity according to standard size of an RJ45 socket is formed in the front space, a receiving groove is defined in a lower side of the socket cavity in communication with the rear space, a step-shaped entry is formed at a rear end of the rear space, a grid section is formed at a lower side of the partition near the receiving groove; and The unit body has a horizontally extending base having a top, a bottom, and a font side, with a bracket extending horizontally from the front side, a PCB secured on the top of the base, a transformer positioned on the PCB in electrical connection with the PCB, with the PCB located intermediate the base and the transformer and separating the base from the transformer, an outer contact portion extending vertically beyond the bottom of the base and extended through the base in electrical contact with the PCB, and an inner contact portion arranged on the bracket in electrical connection with the PCB, whereby the unit body is inserted from the entry of the rear space into the housing, and the bracket is extended into the receiving groove and securely positioned in the receiving groove.

2. The network socket connector as claimed in claim 1, with the bracket located intermediate the top and the bottom of the base.

* * * * *